US005152407A

United States Patent [19]

Massoudnia et al.

[11] Patent Number: 5,152,407

[45] Date of Patent: * Oct. 6, 1992

[54] STACKABLE AND NESTABLE RACKS INCORPORATING STORAGE MEANS

[75] Inventors: Mohammad E. Massoudnia, Creve Coeur, Mo.; Martin Snider, Englewood Cliffs, N.J.; David L. Schwartz, Chesterfield, Mo.

[73] Assignee: Industrial Wire Products, Inc., Sullivan, Mo.

[ * ] Notice: The portion of the term of this patent subsequent to Jul. 30, 2008 has been disclaimed.

[21] Appl. No.: 696,876

[22] Filed: May 8, 1991

Related U.S. Application Data

[63] Continuation-in-part of Ser. No. 582,788, Sep. 15, 1990, Pat. No. 5,035,335, which is a continuation of Ser. No. 351,581, May 15, 1989, abandoned, which is a continuation of Ser. No. 232,018, Aug. 15, 1988, abandoned.

[51] Int. Cl.[5] ..... A47F 5/00

[52] U.S. Cl. ..... 211/181; 211/194

[58] Field of Search ..... 211/181, 188, 133, 194, 211/37; 206/513

[56] References Cited

U.S. PATENT DOCUMENTS

| | | | |
|---|---|---|---|
| 2,600,191 | 6/1952 | Beach . | |
| 2,814,390 | 11/1957 | Barbier . | |
| 2,926,022 | 2/1960 | Nau et al. | 211/133 X |
| 3,435,958 | 4/1969 | Chesley | 211/133 |
| 3,888,353 | 6/1975 | Leifheit . | |
| 4,079,836 | 3/1978 | Von Stein et al. . | |
| 4,444,320 | 4/1984 | Chap . | |
| 4,697,713 | 10/1987 | Pryor . | |
| 4,795,041 | 1/1984 | Remmers | 211/133 |
| 4,805,785 | 2/1989 | Pfeifer et al. . | |
| 4,821,885 | 4/1989 | Ondrasik . | |
| 4,915,238 | 4/1990 | Cassel . | |
| 4,984,694 | 1/1991 | Magnusson | 211/133 X |

*Primary Examiner*—Reinaldo P. Machado
*Assistant Examiner*—Sarah A. Lechok
*Attorney, Agent, or Firm*—Paul M. Denk

[57] ABSTRACT

A stackable and nestable rack construction formed essentially of wire material so as to be capable of use in displaying articles, or for storing personal items, on a select stack of the racks. The racks are capable of being nested in groups, to facilitate their storage, transfer, and display, and then assembled or erected into a stackable configuration, for usage. The racks may accommodate slides, incorporating runners, upon which a wire or other material basket may be accommodated, to add variety to the manner of storage that may be undertaken through usage of this invention. A base member incorporating rollers, may be connectable onto the bottom of the assembly, to add to the maneuverability of the racks, when laddened with stored articles.

23 Claims, 3 Drawing Sheets

STACKABLE AND NESTABLE RACKS INCORPORATING STORAGE MEANS

CROSS-REFERENCE TO RELATED APPLICATION

This application is related to and comprises a continuation in part of the application having Ser. No. 07/582,788, now Pat. No. 5,035,355 filed on Sep. 15, 1990, and which application is related and comprises a continuation of the application having Ser. No. 07/351,581, now abandoned filed on May 15, 1989, and which latter application is designated as a continuation application of the application having Ser. No. 07/232,018, now abandoned filed on Aug. 15, 1988, all of said applications being owned by a common assignee.

BACKGROUND OF THE INVENTION

This invention relates generally to the fabrication, erection, application, and usage of a rack means, generally being stackable and nestable in configuration, formed principally of wire components, which provide for their interengagement and firm attachment due to its inherent resiliency, which affords the user with significant convenience in space savings, as in the closet, with respect to the storage of his/her personal belongings.

A variety of prior art patents are readily available in the art and which disclose means for storing articles, or the like, but generally, as a rule, these storage means, some of which are formed as racks, simply provide for resting of one rack upon the other, in a rather unstable fashion, leading towards the instability of the articles being stored. In addition, and with the exception of the standard type of chest of drawers, or the like, the integration into a rack means of a drawer like storage bin, in the nature of a basket, that is slidingly accommodated by the rack, does not appear to have been given consideration in the art. In addition, the maneuverability of the stacked plurality of racks, so that they can be shifted from one location to the other with facility, with the exception of the common grocery type cart, does not appear to have been considered in the prior art.

For example, the Barbier U.S. Pat. No. 2,814,390, simply discloses a rack fixed to two transverse frames, that form the support members and which appear to rest one upon the other, without incorporating or utilizing the feature of inherent structural resiliency in order to obtain stability, is disclosed in this particular prior art patent.

The Chap U.S. Pat. No. 4,444,320, discloses a stackable shelf unit, formed of wire, but it is to be noted that the units simply stack one upon the other, without utilizing any inherent pressure to sustain the stability of a plurality of such units when stacked one upon the other. In addition, there is no showing of any type of supplemental basket means, cooperating with one or more of the racks, to add further storing features to the stackable shelf unit, as shown.

The Beach U.S. Pat. No. 2,600,191, once again, discloses a knocked down type of display rack, which shows a series of racks that are supported, one upon the other, but other than this relationship, do not display the essence of the current invention in its significant aspects.

The Leifheit U.S. Pat. No. 3,888,353, shows a form of stand for storage of shoes.

The Waxmanski U.S. Pat. No. 3,974,917, discloses a shoe rack stack, but integrates structure that cannot be connected, to add force retention to the stackability of a plurality of such units, as attained from the current invention, nor does it disclose any means for supplementing the storageability of its rack, such as attained from this current development.

The Pfeifer U.S. Pat. No. 4,805,785, discloses another form of stackable shelf unit. The Ondrasik U.S. Pat. No. 4,821,885, discloses a type of stackable and nestable basket device. The Cassel U.S. Pat. No. 4,915,238, discloses another form of stackable shoe rack. The Pryor U.S. Pat. No. 4,697,713, discloses a form of closet storage arrangement.

The Von Stein U.S. Pat. No. 4,079,836, discloses a variety of baskets and supports therefor, for the mass merchandising, handling and display of goods. Once again, it does not appear that any vectorial forces are generated within the structure of this Von Stein device, when the baskets are stacked one upon the other, in order to add to the stability of this particular invention, nor are supplemental baskets provided, that are slidable from storage to operating positions, to add to the convenience of the user. Please note, though, that in FIG. 1 of this patent, it does disclose the use of a dolly, to add to the mobil support of the stacked baskets.

The French patent No. 1.206.143, discloses a shoe rack, where they are stackable one upon the other, to aid in the storage of footwear.

Other United States patents that are known to the applicants, relating to rack means, are shown in the U.S. Pat. Nos. 2,662,662; 2,985,332; 3,149,748; 3,333,722; 3,338,466; 3,395,810; 3,524,565; 3,314,549; 3,704,791; 4,079,836; 4,361,234; and 4,431,408.

The current invention, as to be hereinafter described, adds improved features, that are significant to the functionability of the current invention, enhances its convenience during usage, and furthermore, incorporates structure that makes it inherently more stable during application and storage.

SUMMARY OF THE INVENTION

This invention contemplates the formation and construction of a stackable rack, of the type that has variation in its application, and the uses to be made of the same. For example, the initial concept of this invention is to provide a rack that is formed principally of wire members, fabricated to provide an integrated structure that is reasonably stable in application and usage. But, a plurality of such racks may be stacked one upon the other, not only to provide an elevated storage through a series of racks upon which personal or other articles may be stored, but in addition, the rack incorporates inherent resiliency such that when the racks are stacked together, one upon the other, vectorial forces function to provide significant stability in the arrangement of the racks, one upon the other, to assure that the articles are adequately supported and stored, and remain so even during manipulation of the racks as during usage. But furthermore, the concept of this invention is to provide variations in the structure of the rack, so that it can be constructed to provide for supporting articles of different types, such as clothing, or even of shoes, to provide for their independent display, readily accessible to the owner, but yet conveniently stored in a readily available location, necessitating a minimum of space requirements. Furthermore, other types of personal articles may be stored upon the erected racks, through the application of basket means to the racks, where desired and required, through the application of portable like slide means, alternatively applied to each end of the rack, when constructed and assembled in this manner for usage, so that a basket may be supported within the slide means within a rack, and be maneuvered between a storage position, under the rack, or pulled forwardly, to provide for insertion or withdrawal of personal items therewithin. In addition, the concept of this invention is to provide further maneuverability to the stackable racks, in that a base member, having casters or rollers applied thereto, may be applied to the bottom of the lowermost rack, in order to add to the freedom of movement or shifting of the storage means even when fully ladened with articles, with minimal resistance.

The basic rack means is provided with frames formed as legs at two opposite ends of the shelf of the article carrier or structure means, with the legs incorporating substantially horizontally arranged handles, that are elevated and constructed into the structure slightly upwardly of the structure means, and canted slightly inwardly towards the same. The legs extending therebelow are free standing, and are integrally joined together at their bottoms by means of a substantially horizontally extending foot, with the legs, in combination with the foot, being capable of and subject to flexing, when sprung inwardly towards each other, at opposite ends of a rack, so that the feet on the legs of an upper rack can be engaged in the handles of the rack arranged therebelow, and retained so engaged, by means of the vectorial force directed outwardly, laterally of the rack, in order to bias the legs of the rack above within the handles of the rack therebelow, to add to the stability in the erection and installation of the storage racks when employed. In addition, the placing of one or more articles or objects upon the structure means shelf of the carrier obviously increases the force generated retention of the stacked racks together, adding to the security of the maintenance of the articles, when stored.

The invention is broadly directed to a rack having a shelf that is accessible from any margin, with a pair of leg members connected to the shelf, or its structure means, at opposite lateral margins, being formed with its handle loop portions projecting above the shelf, with the depending leg portions arranged free standing therebelow, in order to provide ample space beneath each rack for storage of personal or other items thereon, upon the rack arranged immediately thereunder. Each depending leg portion is free standing, below the structure means, and incorporates an outwardly turned foot loop, formed of the foot as previously explained, and which are shaped to insert within the handle loop portions of the next rack arranged adjacently thereunder, with the foot elements of the rack above interlocking two vertically adjacent racks together, against separation, until the legs are once again flexed inwardly to release their interlocking connection.

It is the principal object of this invention to provide a stackable series of racks, fabricated essentially of a singular design, but which are stackable together due to their unique construction in order to facilitate their storage, shipment, and display upon the market, and likewise, when not used or employed by the owner.

A further object of this invention is to provide means for adding a vectorial force into the interconnection of a superjacent rack upon a subjacent one, in order to assure greater stability in the mounting and erection of racks one upon the other, when stacked into their usable vertically arranged configuration.

A further object of this invention is to provide base means incorporating rollers or casters that facilitate the maneuverability of the stackable racks, when utilized by the owner.

Still another object of this invention is to provide a base means connectable with a rack arranged immediately thereon and which base means interconnects with the lateral feet of said rack, in a similar manner to that as defined for interconnecting of a pair of vertically adjacent racks together.

Still another object of this invention is to provide slide means that may be integrated into the structure of a rack, beneath its shelf or structure means, in order to accommodate the sliding insertion of a basket means therein, to add to the dexterity of usage of the stackable racks, for storing a variety of different types of personal or other items or articles therein.

These and other objects will become more apparent to those skilled in the art upon reviewing the subject matter of this disclosure, in light of the description of its preferred embodiment, when taken into consideration and viewed with its drawings.

BRIEF DESCRIPTION OF THE DRAWINGS

The present invention is shown in its preferred construction, wherein.

Corresponding reference characters indicate corresponding parts throughout the drawings for this application.

DESCRIPTION OF THE PREFERRED EMBODIMENT

Figure 1:
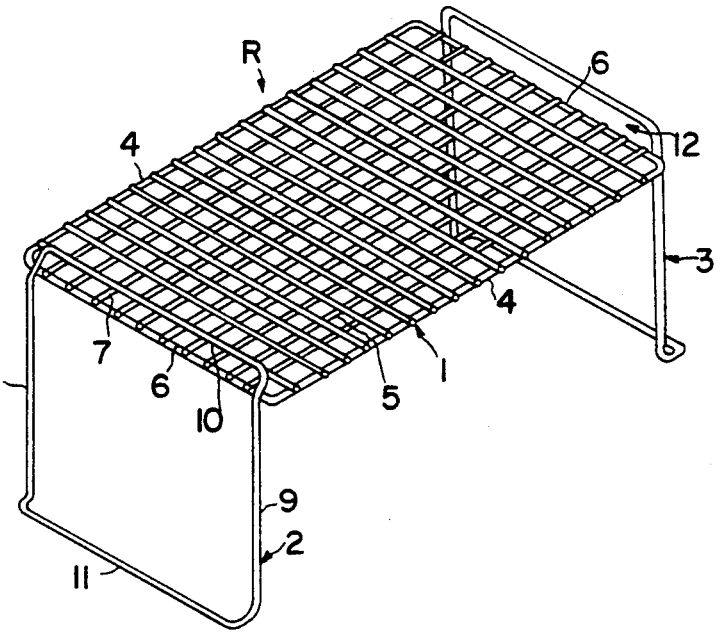
FIG. 1 is an isometric view of a stackable rack of this invention.

In referring to the drawings, and in particular FIG. 1, the rack R of this invention is shown, being constructed of wire parts, to make up the article carrier means of this invention. In its construction, the rack includes a structure or support means 1, formed as a shelf, to make up the article carrier of this construction, and provided at each lateral end of the support means is an approximately vertically erect side frame, two of them as shown at 2 and 3, and which provide vertically displaced support for the support means 1, in its elevation, upwardly off its supporting surface. The support means 1 is formed having a perimeter defining wire, as at 4, of a desired gauge which forms the longitudinal side and transverse end margins of its shown shelf. The longitudinal portions of the perimeter wire offer support for the first series of spaced laterally directed wires 5, while the end portions 6 of the perimeter wire provide support for the series of spaced transversely directed wires 7, as can be seen. Obviously, a single series of such spaced wires may be employed, and have a sheet of other material, such as wood, metal, plastic, or the like, provided thereon, to function as the carrier surface for any load, as an equivalent means for supporting any load upon the support means 1.

The support means 1 is supported by its perimeter wires 4 and 6 on a pair of side frames, such as the side frames 2 and 3, as previously explained, and each side frame is formed having a pair of leg members 8 and 9, as shown, secured by welding, or the like, to said perimeter wire, with each pair of leg members formed having a handle loop, as at 10, extending slightly above the structure or support means 1, and inclined at a small angle inwardly thereof, as can be seen. In addition, each of the leg members 8 and 9 are formed having a bottom foot loop 11 integrally formed thereof, as can be seen, and which turns outwardly, at some degree, oppositely to the direction of the handle loop 10, to not only provide support when the rack functions thereas, but to accommodate the stacking of a plurality of said racks vertically one upon the other, as will be subsequently described. As can also be seen, the side frames are shaped to accommodate such stacking.

The relationship between the approximately horizontally extending handle loop 10, and the upper surface of the support means 1, is such as to provide a spacing therein, as can be seen at 12, so that when the foot of a rack arranged thereabove is flexed inwardly, it can be accommodated within the spacing 12, to assure reinforced stacking of a plurality of such racks one upon the other, when assembled. This relationship generates a vectorial force, outwardly directed, which assures a more snug interconnection of a series of racks together.

Figure 2:
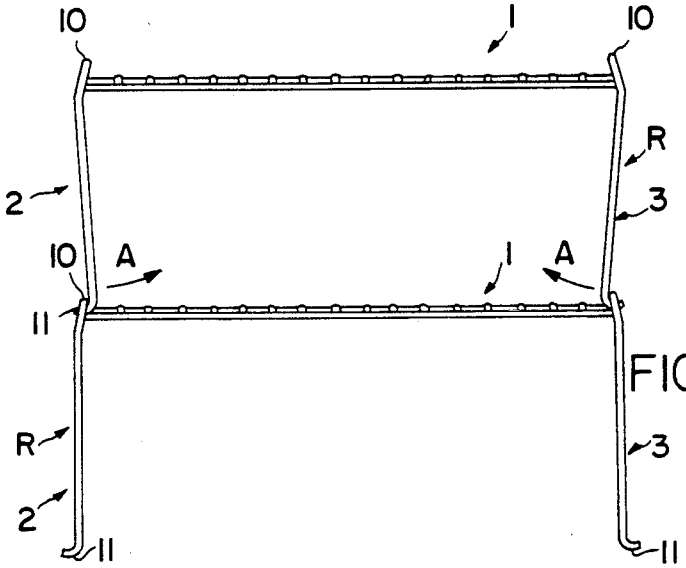
FIG. 2 is a front view thereof, showing two such vertically aligned racks connected together.

As can be more aptly seen in FIG. 2, when a pair of the racks are stacked one upon the other, the legs 2 and 3 are flexed inwardly, as can be noted by the arrows A, for the superjacent rack as disclosed in FIG. 2, to provide clearance for the insertion of a foot 11 within the spacing 12 of the formed handle loop 10, of the subjacent rack. In this manner, through the inward flexing of the legs 2 and 3, in the manner as described, there is generated a horizontally directed force, that urges the legs outwardly, so as to provide for a somewhat binding of the legs 2 and 3 within the handle loops 10, to afford a pressured engagement between stacked racks, to add to their stability, as during usage. This has been described in our prior applications, as identified herein. The contents and description in said applications are incorporated herein by references.

Figure 3:
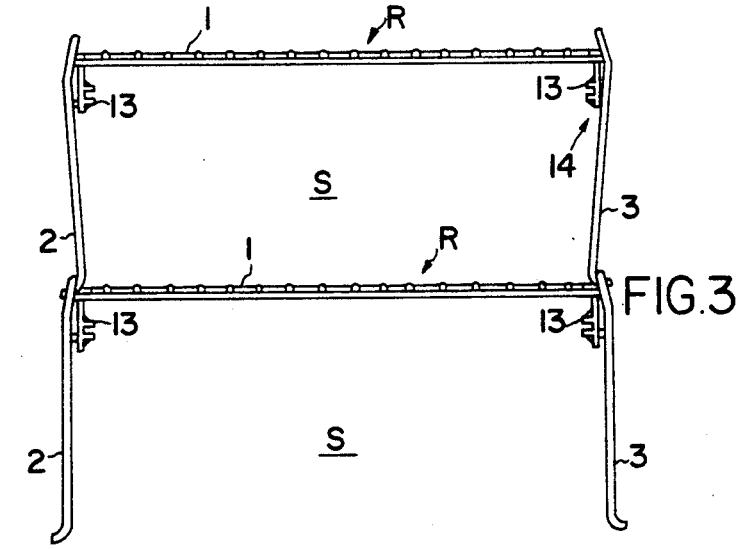
FIG. 3 is a view similar to that as shown in FIG. 2, showing the connection of the basket supporting slide means applied to each rack.

As can be seen in FIG. 3, there is adequate space, as noted at S, formed beneath each of the racks R, and this space may be utilized for storage of personal items or articles upon each of the support surfaces, as noted, or in the alternative, and as a further modification to the structure, application, and usage of this invention, basket means may be provided therein, as will be subsequently described. As noted, runners or slide means, as shown at 13, are optionally provided for connecting with the juncture of the side frames 2 and 3 with their support means 1, and are stabilized, in the preferred embodiment, by clipping onto the lateral ends, as at 6, of the said means, while the back edges of the slides bias against the side frames 2 and 3, to furnish their precise positioning for usage when functioning as a rail for supporting a basket means of this invention. This can be seen at 14.

Figure 4:
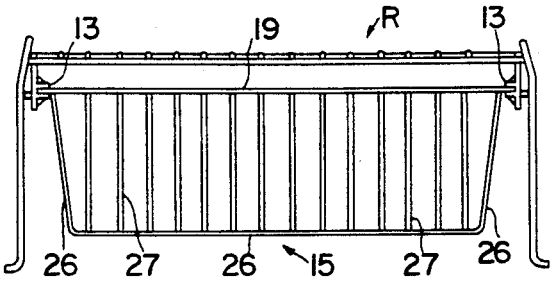
FIG. 4 is a view of one of the stackable racks, with a basket slidably supported under its support means, or shelf.
Figure 5:
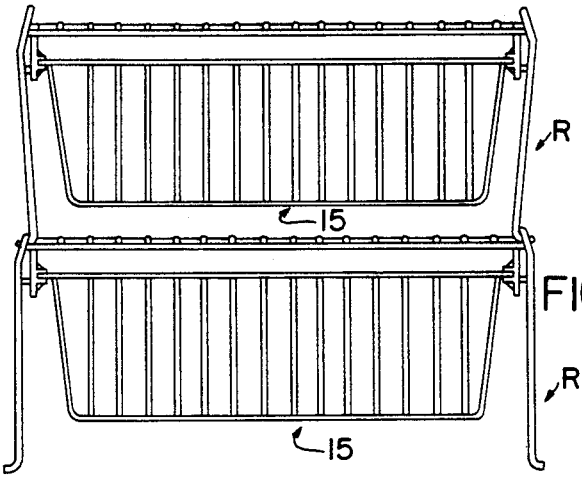
FIG. 5 discloses a view similar to that as shown in FIG. 4, but showing a pair of the vertically aligned stackable racks holding their respective basket means.

The accommodation of a basket means 15, within a rack R, can be seen in FIG. 4, with a basket being supported within a pair of slide means 13, as noted. In addition, the facility of this particular invention to provide for the usage and application of a basket to one or more of the racks, can be noted in FIG. 5. On the other hand, while a pair of such baskets are shown connecting to each of the pair of vertically aligned and stacked racks R, it is just as likely that a basket may be accommodated by one of the racks, but that a basket and its slide means may not be connected with the other rack, in order to provide a storage shelf type of space for accommodating the arrangement of other type articles thereon, as can be readily understood, so as to accommodate the needs of the user, and to afford temporary or permanent storage to articles, of varying types and sizes as required.

Figure 8:
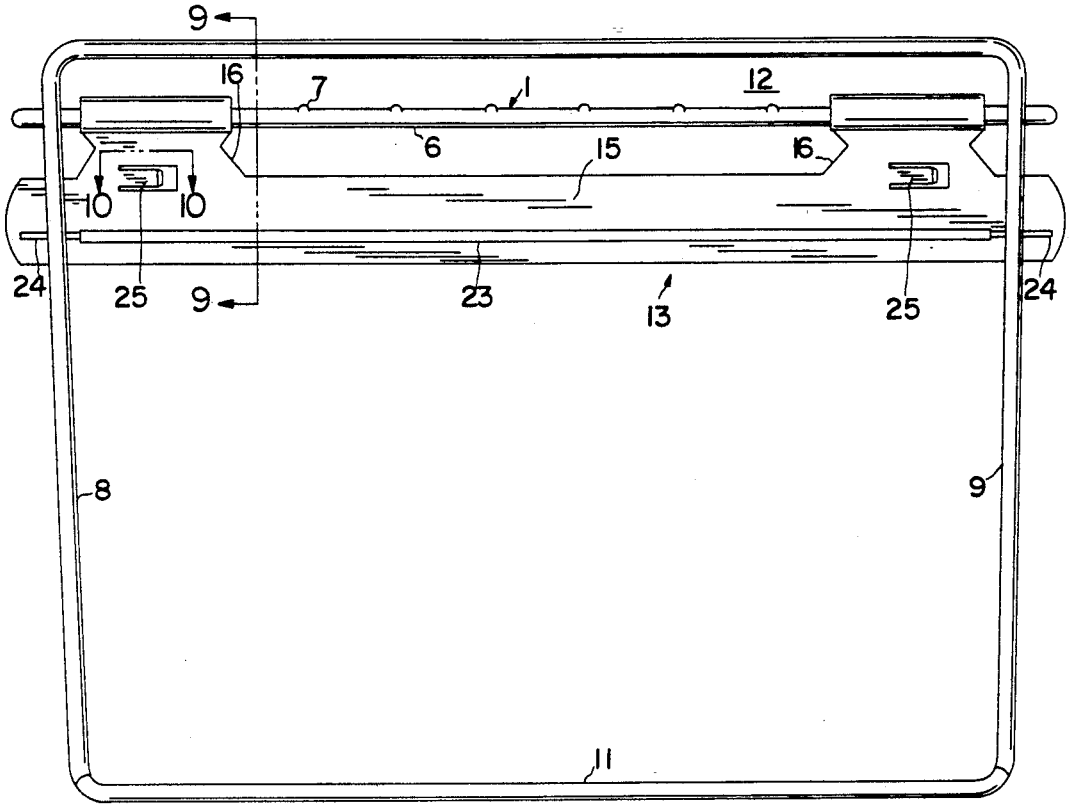
FIG. 8 is an end view of a rack disclosing the slide means attaching laterally therewith.
Figure 9:
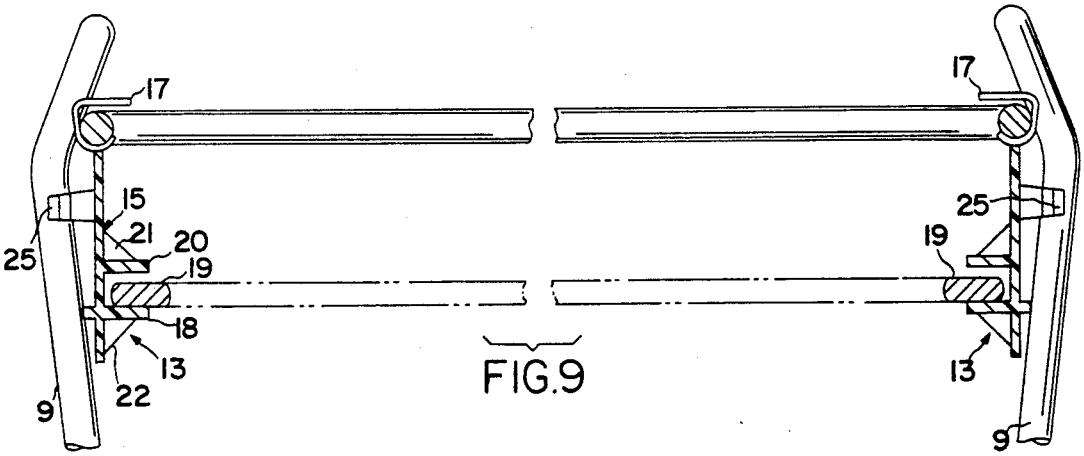
FIG. 9 is a lateral sectional view of a rack, and its attached slide means, taken along the line 9—9 of FIG. 8.

The configuration and shape of each slide means 13 of this invention is more adequately disclosed in FIGS. 8 and 9. As disclosed, each slide means is formed as an integral structure, there being one provided attaching onto each lateral end of the rack, and may be fabricated as a molded structure, as of metal or polymer, into its unique shape for providing the attributes required for functioning as a slide means or rail for supporting one of the basket means of this invention. As shown, each slide means 13 includes an elongated structure, as at 15, and at approximately each end is furnished an integrally upwardly extending neck, as at 16, which is formed into the shape of a resilient clip, as at 17, to provide for its snap clasping on to the proximate end of the support means 1, including its perimeter wire 6, and the transverse wires 7, as can be noted. When assembled in this manner, the slide means, through its clasp 17, is snugly connected at the end of the support means 1, and in this position, is available for accommodating the repeated sliding of a basket means, as at 15, therein. Extending from the inward surface of the elongated member 15 are a series of rails or runners, with the first or lowermost runner 18 as integrally formed with the elongate member, providing the support for accommodation of the upper rim 19 of a basket therein, while a second runner 20, formed thereabove, functions to confine the basket with respect to its slide means, to assure that convenient sliding in and out of the basket can be made, without wobbling or disruption. Various reinforcing gussets, as at 21 and 22, are provided, respectively, for assuring the structural reinforcement of the runners 18 and 20, even during repeated usage of a rack, and its basket means, for storing articles. Extending from the opposite side of the elongate member 15 is another rail, as at 23, which adds to the reinforcement of the slide means, but in addition, has an offset portion, as at 24, at each end of the rail, which provides convenient spacing for biasing of the rail, and the slide means, against the contiguous legs 8 and 9, of the side frames 2 and 3, so as to assure stability, and proper and convenient positioning and alignment of the slide means, during their application. A plurality of such rails 23 may be provided on the side of a member 15 to assure stability.

Figure 10:
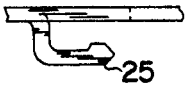
FIG. 10 is a partial sectional top view of an interconnecting clip, taken along the line 10—10 of FIG. 8.

In addition, formed extending further outwardly of each of the slide means 13 are a pair of clips, as at 25, as can be seen in FIG. 10, and these clips are furnished for cooperating with similar clips formed upon slide means of the stackable racks that may be arranged in horizontal adjacency, to provide for interconnecting of a series of vertically aligned racks, together, when arranged in side-by-side fashion. In addition, these are useful and designed for attaching onto the wire basket by hooking around wires to temporarily adhere the slide means to a basket as during shipping, warehousing, and display.

As can be noted in FIG. 4, in addition to FIG. 9, each of the basket means 15 are formed of a series of strategically bent and applied wires, in the manner as known in the art, with a series of end wires 26 being bend downwardly, and across the bottom of the formed basket, while a series of transverse wires, as at 27, likewise are arranged downwardly, and across the bottom, to form a gridwork for support of any articles arranged therein The upper ends of the various wires 26 and 27 are welded or otherwise secured to a perimeter rim, as at 19, as previously explained, and this perimeter rim 19 is formed of more flattened stock, as can be seen in the cross-section in FIG. 9, to provide a widened lip that may be accommodated upon the bottom runner 18, as when the basket is slid into the various slide means, when assembled for usage.

Figure 6:
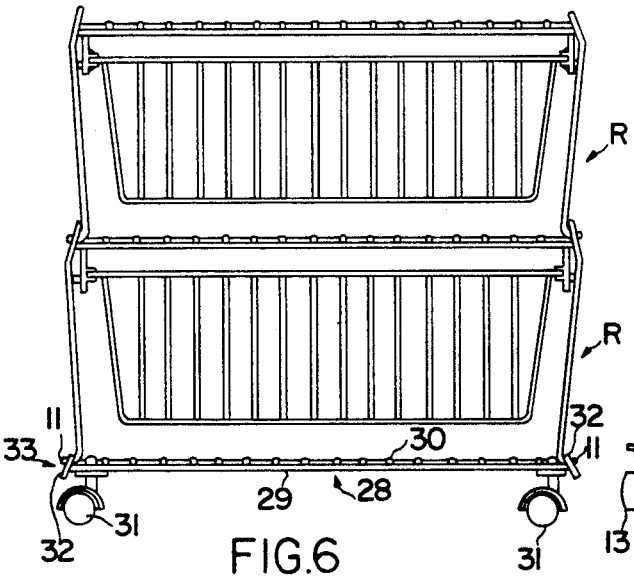
FIG. 6 is a view similar to that of FIG. 5, but disclosing the attachment of the base means, mounted upon casters, securing to the bottom of the lowermost rack.

As can be seen in FIGS. 6 and 8, when a series of the stackable racks are arranged one above the other, for usage, and the stacking of such racks can really be done to a plurality or significant numbers of such vertically arranged racks, when a variety of articles are stored within each rack basket means, or upon a support or structural means 1, as where a basket may not be used at a particular level, the weight of the entire assembly may be significant. Therefore, in order to accommodate the maneuverability of the entire assembly, as when it requires movement, there may be provided at the bottom of the stacked arrangement, a base means, as shown at 28, in order to provide greater maneuverability to the assembly. As disclosed, the base means includes likewise a perimeter wire 29, extending around the periphery of the base, and has a series of cross wires, as at 30, secured thereon, in order to provide another supporting surface upon which articles may be stored, if a basket means is not used immediately thereabove. Extending downwardly from the base means 28 are a series of casters, or rollers, as at 31, to provide for the desired maneuverability of the stacked racks. Rigidly connected at the ends of each perimeter frame 29, of the base means, is an upwardly extending wire formed loop, as at 32, having a shape and configuration similar to that of the handle loops 10, as previously described, so that the feet 11 of the rack arranged thereabove, can be bent inwardly and inserted therein, and held in position in the manner as described for the interconnection between the feet of a rack, and the handle loop of the subjacent rack arranged therebelow, in the manner as analyzed. Each of the wire loops 32 have adequate spacing provided therein, as noted at 33, to accommodate the insertion of foot 11 therein, in the manner as previously described, after the legs 8 and 9 have been flexed inwardly, so as to provide a constant bias of the legs against the wire loop 32, when a rack has been mounted upon a base means 28, as can be understood.

Figure 7:
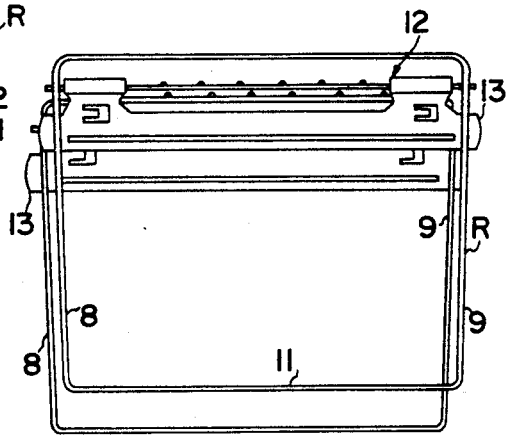
FIG. 7 is a side view of a pair of stacked racks.

As was reviewed and explained with respect to the parent applications upon this invention, and as alluded to previously herein, these racks R are stackable in their configuration, to facilitate their storage, shipment, and display, as when marketed. FIG. 7 discloses how the racks are stackable one upon the other, and such stackability can yet be attained even when the slide means 13 have previously been connected onto each of the racks, in preparation for their accommodating a basket means 15, when employed. It should also be noted from FIG. 7, in a manner similar to that as shown in FIG. 8, that the legs 8 and 9 incline downwardly, and inwardly, in their construction, so as to provide adequate clearance for the insertion of a leg member 11 within the spacing 12 of a handle loop 10, when the racks are stacked one upon the other, in preparation for usage. Such explains the facility that has been designed into the fabrication of these wire formed stackable racks, in order to assure immediate usage by the purchaser, with a minimum of assembly required.

Variations or modifications to the subject matter of this invention may occur to those skilled in the art upon reviewing the concept of this invention as described herein. Such variations or modifications, if within the spirit of this invention, are intended to be encompassed within the scope of any claims to patent protection issuing upon this development. For example, select components of the rack may be fabricated from other materials, such as wood or plastic, as for style purposes. The description of the preferred embodiment set forth herein, in addition to its disclosure within the drawings, is provided for illustrative purposes only.

Having thus described the invention what is claimed and desired to be secured by Letters Patent is:

1. In a rack generally constructed of wire components formed to permit storage of articles thereon, the improvement comprising:

approximately vertically erect side frames provided at each end of the rack, a substantially horizontally extending handle and a substantially horizontally extending foot, provided respectively at the upper and lower ends of the side frames at each end of the rack;

an elongated structure means extending the length of the rack and interconnecting and retaining the side frames fixedly at opposite ends of the structure means, said structure means formed to support articles to be racked thereon;

a pair of slide means, one each connecting to at least one of said side frames and structure means, at both ends of the rack; and basket means, having a height less than than the side frames, slidingly supported by the pair of slide means and capable of being shifted forwardly for deposit or withdrawal of articles from within the basket means, and capable of being shifted underneath of the rack for storage thereof.

2. The invention of claim 1 and wherein said side frames incorporating leg members formed of wire, and said handle and foot each formed of wire.

3. The invention of claim 2 and wherein said structure means comprising an elongated wire structure.

4. The invention of claim 3 and wherein said basket means comprising a wire formed basket.

5. The invention of claim 2 and wherein said handle and foot respectively connecting at the upper and lower ends of the leg members.

6. The invention of claim 5 and wherein each said slide means containing at least one laterally extending first runner, and said basket means supported on said runners for attaining sliding movement thereon.

7. The invention of claim 6 and including a second runner arranged above each said first runner for each slide means and confining and stabilizing the sliding movement of the basket means with respect to each supporting slide means.

8. The invention of claim 7 and wherein said structure means comprisng an elongated wire structure.

9. The invention of claim 8 and wherein said slide means clips onto each end of the elongated wire structure means.

10. The invention of claim 9 and wherein each slide means includes at least one portion that contacts against the leg members to stabilize the support of the basket means upon the slide means during usage.

11. The invention of claim 2 and including a base means, said base means retained proximate the lower end of said side frames, and said base including means for facilitating the movement of the rack, and basket means, during usage.

12. The invention of claim 11 and including rollers connecting to the base means to facilitate the shifting of said base means, rack, and basket means.

13. The invention of claim 2 and including at least two of said racks, said racks being formed of wire components and providing stacking and nesting of two or more racks together, each foot of a first rack cooperating with the handle of a rack arranged therebelow to provide for an engaging securement of at least a pair of racks when stacked, and each wire leg member having sufficient flex to provide for its inward bending during engagement or disengagement of the foot from the handle of a subjacent wire rack as during their assembly.

14. The invention of claim 13 wherein the elongated structure means comprises a wire formed shelf.

15. In a rack constructed of wire components formed to permit stacking and nesting of two or more racks, the improvement comprising:

vertically erect leg members formed of wire and provided at each end of the rack, a substantially horizontally extending handle and a substantially horizontally extending foot, each formed of wire, provided respectively at the upper and lower ends of the leg members at each end of the rack;

a substantially elongated wire structure extending the length of the rack and interconnecting and retaining the leg members fixedly at opposite ends of the said wire structure, said wire structure formed to support articles to be racked thereon;

each handle disposed a minor distance above the wire structure, and each foot disposed a substantial distance below the wire structure so as to provide substantial space under each wire structure for the insertion or removal of any articles stored upon the wire structure of the rack arranged therebelow; and each foot of a first rack cooperating with the handle of a rack arranged therebelow to provide for an engaging securement of at least a pair of racks when stacked, and each wire leg member having sufficient flex to provide for its inward bending during engagement or disengagement of the foot from the handle of a subjacent rack as during their erecting.

16. The invention of claim 15 wherein the elongated wire structure comprises a wire formed shelf.

17. The invention of claim 16 and including a base means, said base means cooperating with the foot of the rack provided thereon to provide stability for the plurality of racks when erected for usage.

18. The invention of claim 16 and including roller means, said roller means mounted to the underside of the base means, and said roller means mounted base facilitating the movement of the erected racks when shifted during usage.

19. The invention of claim 15 wherein said elongated wire structure being formed of at least a pair of elongated wires extending between the leg members, with select wires of the pair being arranged vertically displaced from each other in the rack construction to facilitate the storage of any article thereon.

20. In a rack constructed of wire components formed to permit stacking of two or more racks, the improvement comprising: vertically erect side frames formed of wire and provided at each end of the rack, a substantially elongated wire structure extending the length of the rack and at its ends interconnecting and retaining approximately the upper ends of the side frames fixedly to the said wire structure, said wire structure formed for functioning as a support means to support articles to be racked thereon, loop means provided proximate the upper ends of the side frames and at opposite ends of the support means, at each end of the rack, each side frame having bottom means, each bottom means of a first rack cooperating with the loop means of the rack arranged therebelow to provide for an engaging securement of at least a pair of racks when stacked, and each side frame having sufficient flex to provide for its resilient bending during engagement of disengagement of the bottom means from the loop means of a subjacent rack as during their erecting and dismantling.

21. The invention of claim 20 wherein the support means comprising an elongated wire structure forming a wire shelf.

22. The invention of claim 21 where in said side frames resiliently flex inwardly when engaging or disengaging the loop means.

23. The invention of claim 20 wherein each bottom of a first rack when secured within the loop means of the rack arranged therebelow maintaining a pressurized engagement therewith to add stability to the racks when stacked.

* * * * *

UNITED STATES PATENT AND TRADEMARK OFFICE

CERTIFICATE OF CORRECTION

PATENT NO. : 5,152,407
DATED : October 6, 1992
INVENTOR(S) : Mohammad E. Massoudnia, et. al.

It is certified that error appears in the above-indentified patent and that said Letters Patent is hereby corrected as shown below:

Column 8, Claim 1, line 46, change "than than" to --than--.

Column 9, Claim 8, line 4, change "comprisng" to --comprising--.

Column 10, Claim 20, line 41, change "of" in the first occurrence to--or--.

Signed and Sealed this

Twenty-eighth Day of September, 1993

*Attest:*

Bruce Lehman

BRUCE LEHMAN

*Attesting Officer*

*Commissioner of Patents and Trademarks*